US007594342B2

(12) United States Patent
Thom et al.

(10) Patent No.: US 7,594,342 B2
(45) **Date of Patent: *Sep. 29, 2009**

(54) SPHERICAL DESICCATOR

(75) Inventors: Paul Thom, Butler, NJ (US); David Landsberger, Caldwell, NJ (US); Francis Gomes, Lincoln Park, NJ (US)

(73) Assignee: Bel-Art Products, Inc., Pequannock, NJ (US)

( * ) Notice: Subject to any disclaimer, the term of this patent is extended or adjusted under 35 U.S.C. 154(b) by 186 days.

This patent is subject to a terminal disclaimer.

(21) Appl. No.: 11/495,468

(22) Filed: Jul. 28, 2006

(65) Prior Publication Data

US 2007/0209225 A1 Sep. 13, 2007

Related U.S. Application Data

(60) Provisional application No. 60/781,948, filed on Mar. 10, 2006.

(51) Int. Cl.
*F26B 13/30* (2006.01)

(52) U.S. Cl. ..... 34/92; 34/218; 206/583; 426/472

(58) Field of Classification Search ..... 34/92, 34/201, 218, 380, 381, 403; 206/521, 583; 426/472, 480

See application file for complete search history.

(56) References Cited

U.S. PATENT DOCUMENTS 2,742,709 A * 4/1956 De Woody et al. ..... 34/92
4,087,980 A 5/1978 Kono
4,228,935 A 10/1980 Madray
4,300,654 A 11/1981 Raymond et al.
4,479,571 A 10/1984 Eliot
4,540,343 A 9/1985 Perkins
4,585,400 A 4/1986 Miller
4,730,989 A 3/1988 Laing
4,842,347 A 6/1989 Jacobson
5,078,308 A 1/1992 Sullivan
5,198,523 A 3/1993 Baumann et al.
5,300,138 A 4/1994 Fischer et al.
5,503,305 A 4/1996 Anderson
5,628,665 A 5/1997 Lang et al.
5,702,508 A 12/1997 Moratalla
5,807,422 A 9/1998 Grgich et al.
5,878,909 A 3/1999 Rogow
6,193,117 B1 2/2001 Poschelk
6,616,062 B2 9/2003 Boecking
6,682,764 B1 * 1/2004 Morris et al. ..... 426/243
6,843,541 B1 1/2005 Mills et al.
6,851,769 B2 2/2005 Kono
D556,895 S * 12/2007 Thom et al. ..... D24/108
D566,832 S * 4/2008 Thom et al. ..... D24/108

* cited by examiner

*Primary Examiner*—Stephen M. Gravini
(74) *Attorney, Agent, or Firm*—Lowebstein Sandler PC

(57) ABSTRACT

A spherical vacuum desiccator consists of two substantially identical shells which are connected together at an engagement region. A receiving segment and connecting segment are positioned in a spaced-apart relationship within the engaging region of each hemispherical shell. In the assembled condition of the invention, each hemispherical shell is disposed in an inverted position with respect to the other shell and the connecting segment of the two hemispherical shells engage at the receiving segment.

16 Claims, 11 Drawing Sheets

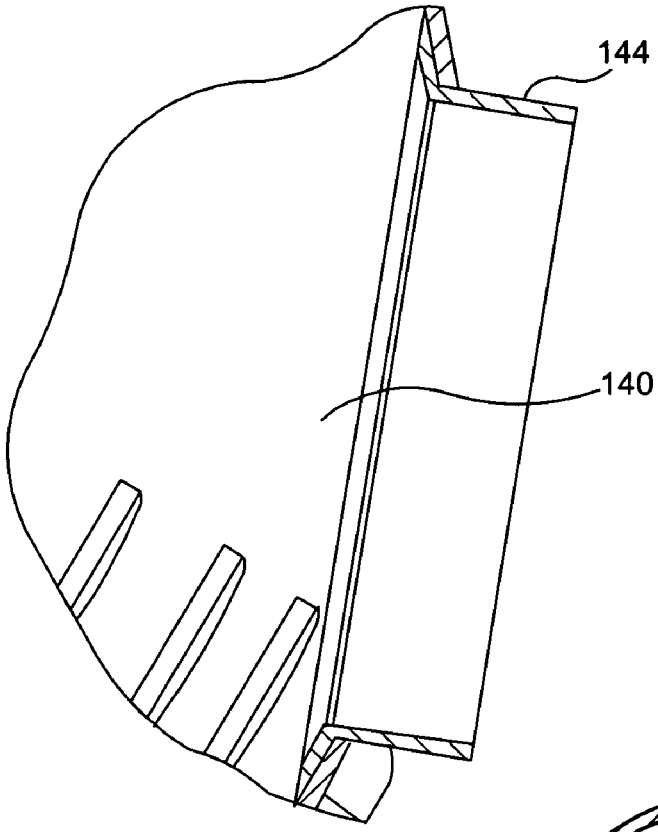
F I G. 16
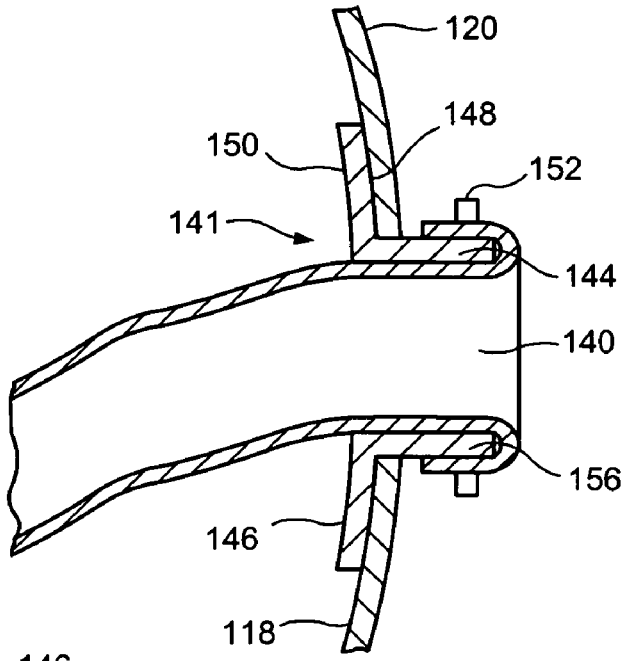
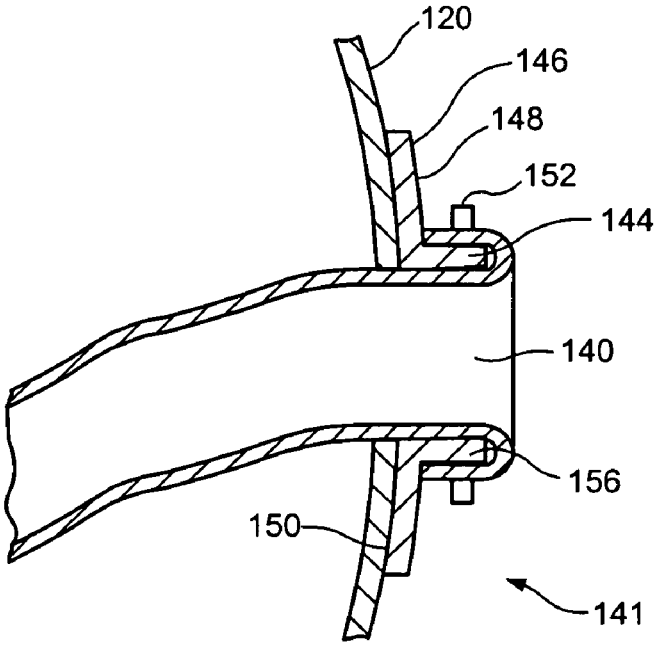
F I G. 17
F I G. 18

SPHERICAL DESICCATOR

This non-provisional application claims priority under 35 USC 119(e) of U.S. Provisional Application Ser. No. 60/781,948 filed by Paul Thom, David Landsberger, and Francis Gomes on Mar. 10, 2006.

FIELD OF THE INVENTION

The present invention relates generally to arrangements adapted for removing moisture, and more specifically, it relates to an apparatus for removing moisture which is capable of withstanding substantial internal pressure.

BACKGROUND OF THE INVENTION

Arrangements for removing moisture from enclosures are widely used in industries in which products stored must be maintained at a sufficiently low moisture level or content to preserve their functional integrity. The ability to maintain reduced moisture levels is particularly critical in laboratory environments since it is commonly required to store chemicals, materials, and products which are particularly susceptible to moisture damage. Vacuum desiccant devices capable of producing and maintaining a vacuum within the respective working chambers are known in the art.

It is also well known that desiccation is limited by the maximum safe working pressure the device can withstand. While a plethora of such devices are known in the art of various designs and configurations, many of them are of less than ideal construction. The ability of a vessel to maintain structural integrity is limited by the rupture strength of the valve and pipe systems and the tensile strength of the walls. This point is usually the point at which there is the lowest tensile strength which limits the usefulness of the entire structure. As the pressure inside the desiccator decreases, the likelihood of rupture increases.

Prior art vessels are severely limited in strength as size increases and are problematic to scale up. A sphere, in contrast to all other configurations, is perfectly symmetrical and has an equal distance from the center point to any point on the surface. The true sphere has the smallest surface area among all surfaces enclosing a given volume and it encloses the largest volume among all closed surfaces with a given surface area.

While semi-spherical hollow desiccators exist, to the best knowledge of the inventors, no true hollow, spherical desiccators are known in the art. In this respect, the spherical vacuum desiccator device of the present invention substantially departs from conventional concepts and designs of the prior art. By providing a desiccator with a true spherical working or desiccation chamber, it is possible to achieve substantial safety of the device. Any other shape provides weak points at the joints and corners which forces the user not to apply extreme pressure or risk breakage or injury.

In the prior art, glue, solder, epoxy, and other binding agents as well as welding, etc. are often required to secure the structural elements of the desiccator together. For example, in the formation of desiccator cabinets and the like, the connecting area between one side and another must be sealed. In a typical box-like structure, there are many engagement areas providing multiple points of weakness, thus making a strong seal difficult. These connecting areas are prone to leakage and may become one of the weakest areas in the device, especially when the body of the desiccator and the interior region thereof are exposed to substantial positive and/or negative pressure conditions. The need to fortify these connecting points and the use of multitude structural elements increases the cost and complexity of such prior art desiccation devices.

It is known in the art, such as is disclosed in U.S. Pat. No. 5,807,422 to Grgich, et al, that the lower the velocity of the gas, the closer the dynamic capacity is to the static capacity of the desiccant. As velocity is decreased, the capacity of the desiccant, namely, the ability to absorb liquid from a gas, is increased because the time that the gas is in contact with the absorbent is increased. As the linear gas velocity through the desiccant bed is lowered, the dynamic capacity of the desiccant is increased since the gas molecules are in contact with the absorbent for a greater period of time. Slowing the velocity of the gas may be accomplished by increasing the size of the vessel or decreasing the pressure inside the vessel. This may be accomplished by decreasing the temperature. However, the Grgich device is limited in structure because a true sphere is not disclosed. Further, a hollow area for equal air flow is not disclosed, but rather a spherical desiccant absorption unit composed of zones and so does not solve the present problem of equal air flow and unlimited scalability while maintaining complete structural integrity. While temperature control is also an issue in the Grgich patent due to the limited volume in the absorption bed, this problem has been solved by the present invention by providing a single air cavity structurally designed for equal air flow.

Thus, there has been a long felt and unsolved need for a simple, inexpensive, and reliable desiccator capable of withstanding great positive and negative pressure, the desiccator capable of providing a uniform distribution of gas within the working chamber.

SUMMARY OF THE INVENTION

One aspect of the invention discloses a spherical vacuum desiccator having first and second substantially identical hemispherical shells adapted for mutual engagement with each other. Each hemispherical shell consists of a body with inner and outer hemispherical surfaces and an engaging region provided there between. A receiving segment and a connecting segment are positioned in a spaced-apart relationship within the engaging region. In the assembled condition of the invention the connecting segment of the first hemispherical shell engages the receiving segment of the second hemispherical shell. The inner surfaces of the first and second shells define a substantially hollow operative chamber within the desiccator having a true spherical configuration.

As to another aspect of the invention, in each hemispherical shell the engaging region includes a flange extending outwardly from the outer surface and extending circumferentially so as to substantially surround the outer periphery of the respective shell. In each hemispherical shell the connecting and receiving segments form the respective projections extending outwardly from the flange so as to be disposed within the flange opposite to each other. The receiving segment consists of a receiving recess extending inwardly from the outer periphery from the respective projection. On the other hand, in each hemispherical shell, the connecting segment consists of a connecting member extending transversely to the surface of the respective projection.

As to a further aspect of the invention, in the assembled condition of the spherical vacuum desiccator, the first hemispherical shell is disposed in an inverted position with respect to the second hemispherical shell in such a manner that the connecting member of one shell engages the receiving recess of another shell forming a hinge connection facilitating pivotal motion between the first and second hemispherical shells.

In the assembled condition of the desiccator, the first hemispherical shell can be disposed having the respective interior hemispherical surface and the receiving recess to face upwardly, so as to receive the respective connecting member of the second shell, as to facilitate pivotal motion of the second shell with respect to the first shell.

Still another aspect of the invention provides a hemispherical shell for a substantially spherical desiccator which consists of a body with inner and outer hemispherical surfaces and an engaging region positioned there between. A receiving segment and a connecting segment are positioned in a spaced-apart relationship on the engaging region. The engaging region may include a flange extending outwardly from the outer surface and circumferentially so as to surround the outer periphery of the hemispherical shell. The connecting and receiving segments form respective projections extending outwardly from the flange so as to be disposed within the flange opposite to each other.

As to still another aspect of the invention, the receiving segment consists of a receiving recess extending inwardly from the outer periphery from the respective projection. The connecting segment consists of a connecting member extending transversely to the surface of the respective projection.

Still another aspect of the invention, the longitudinal extension of the connecting member is substantially equal in length to the depth of the receiving recess.

BRIEF DESCRIPTION OF THE DRAWINGS

FIG. 16 is an enlarged view showing the detail of FIG. 15;

FIG. 17 is a partial sectional view showing one embodiment of the glove accessory in an assembled condition thereof; and FIG. 18 is a partial sectional view showing a further embodiment of the glove accessory in an assembled condition thereof.

DESCRIPTION OF THE PREFERRED EMBODIMENT

Figure 4:
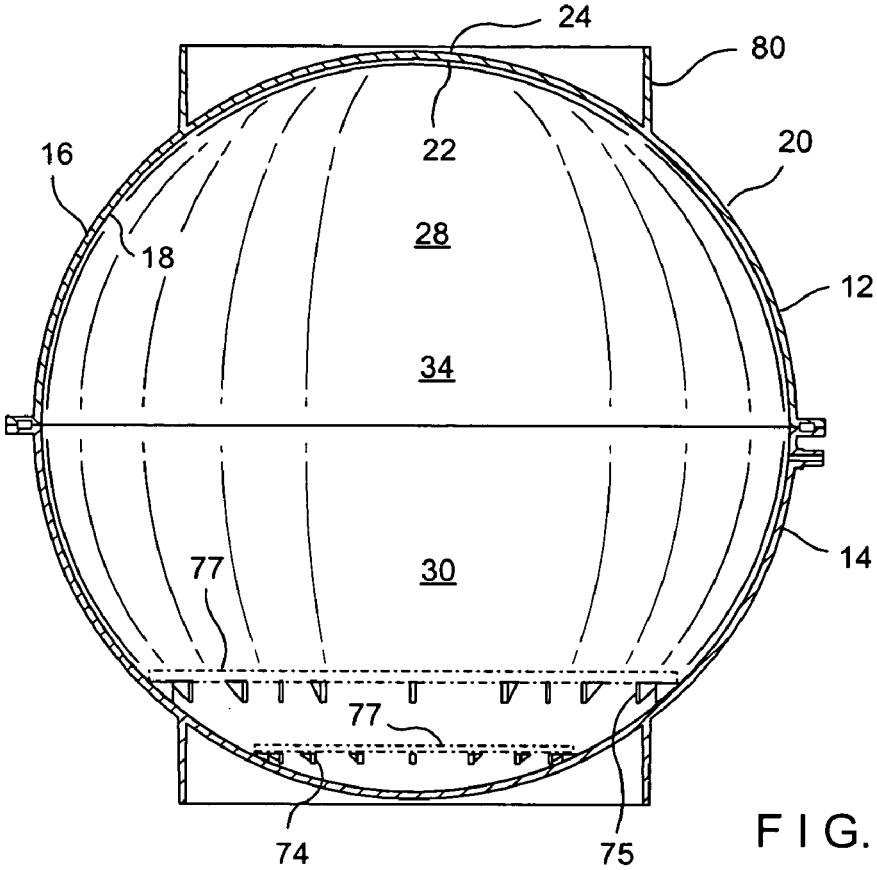
FIG. 4 is a sectional view according to section line 4-4 of FIG. 2.
Figure 5:
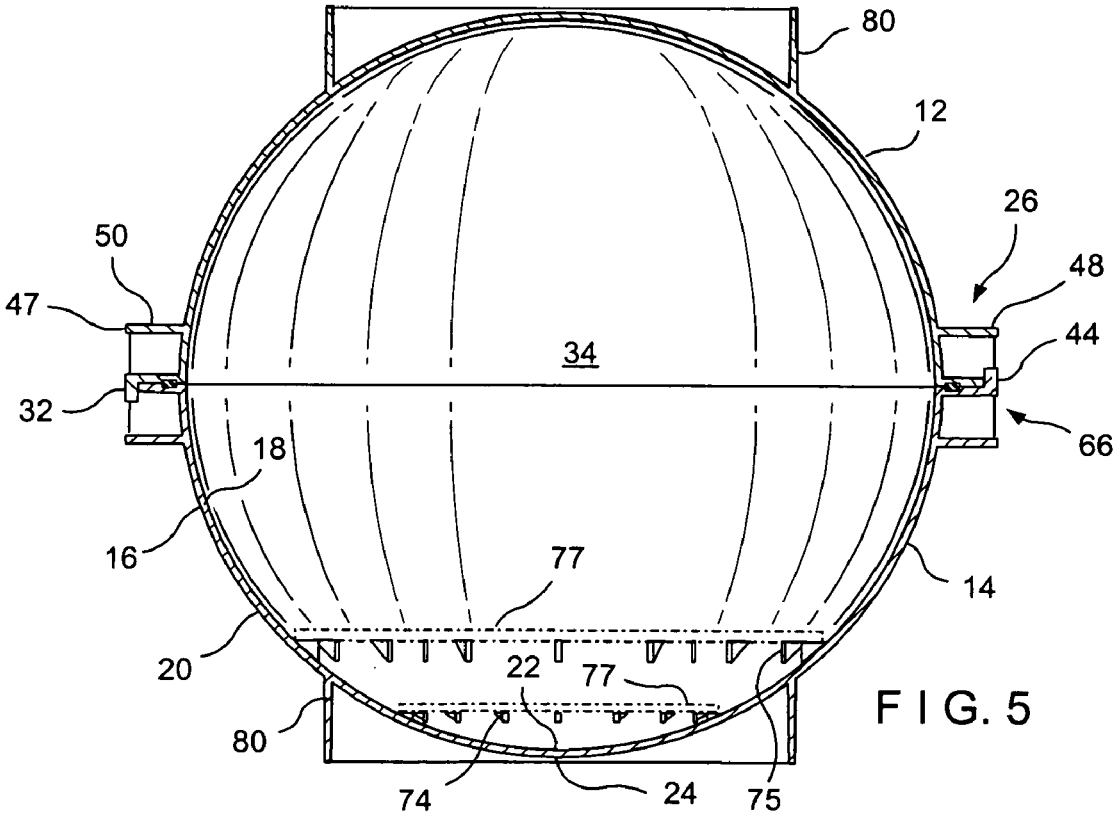
FIG. 5 is a sectional view according to section line 5-5 of FIG. 3.

Referring now to the drawings in general and to FIGS. 1-7, specifically showing a vacuum desiccator 10 of the invention, which is formed by a combination of practically identical first 12 and second 14 shells adapted for mutual engagement with each other. As best illustrated in FIGS. 4 and 5, in the preferred embodiment each shell consists of a body 16 having an interior hemispherical surface 18 and exterior surface or portion 20 culminated at one end by respective poles 22, 24, with an engaging interface 26 provided at another end thereof. In the assembled condition the desiccator 10 consists of a first hemispherical cavity 28 and second hemispherical cavity 30, which are formed by the matching interior substantially hemispherical surfaces 18 of the respective shells. The interior surfaces 28 and 30 of the first and second cavities substantially mirror each other and interlock in an airtight seal at a connecting region 32, which is equidistantly oriented between the poles of the respective hemispherical cavities. In this manner a hollow, spherical operational chamber 34 capable of withstanding extreme positive or negative air pressure is formed.

While the drawings depict exterior portions or surfaces 20 as being hemispherical in nature, this is taught by way of example only. The exterior portion 20 of the desiccator of the invention may be of any conventional configuration such as cubical, tetrahedral, or otherwise polyhedral. The exterior portion may form a unitary structure with the interior surfaces 18 or may be a separate entity which encloses the device partially or fully.

As should be readily apparent from the accompanying drawing figures, the first 28 and second 30 hemispheres are substantially identical in structure, and in the assembled state the first hemisphere 12 has an inverted orientation with respect to the second hemisphere 14 and vise versa. Consequently, the desiccator assembly is depicted in a vertically oriented manner throughout the drawings.

In each shell the engaging interface 26 includes an engaging flange 38 extending in the plane dissecting the interior and exterior surfaces. In the preferred embodiment the engaging flange originates from the hemispherical inner surface 18, passes through the body 16 and extends outwardly from the exterior portion or surface 20 circumferentially, so as to substantially surround the exterior periphery of the respective shell. The engaging interface 26 of each shell also includes connecting 40 and receiving 42 segments in the form of respective projections which are spaced apart from each other and extend outwardly from an outer periphery of the engaging flange. A receiving recess 46 is provided in the receiving segment 42 extending inwardly from the outer periphery of the respective projection. On the other hand, in each shell, the connecting segment 40 includes a connecting member 44 extending transversely to the surface of the respective projection. The connecting segment 44 of the first hemispherical shell is configured for engagement with the receiving recess 46 of the second hemispherical shell.

Figure 1:
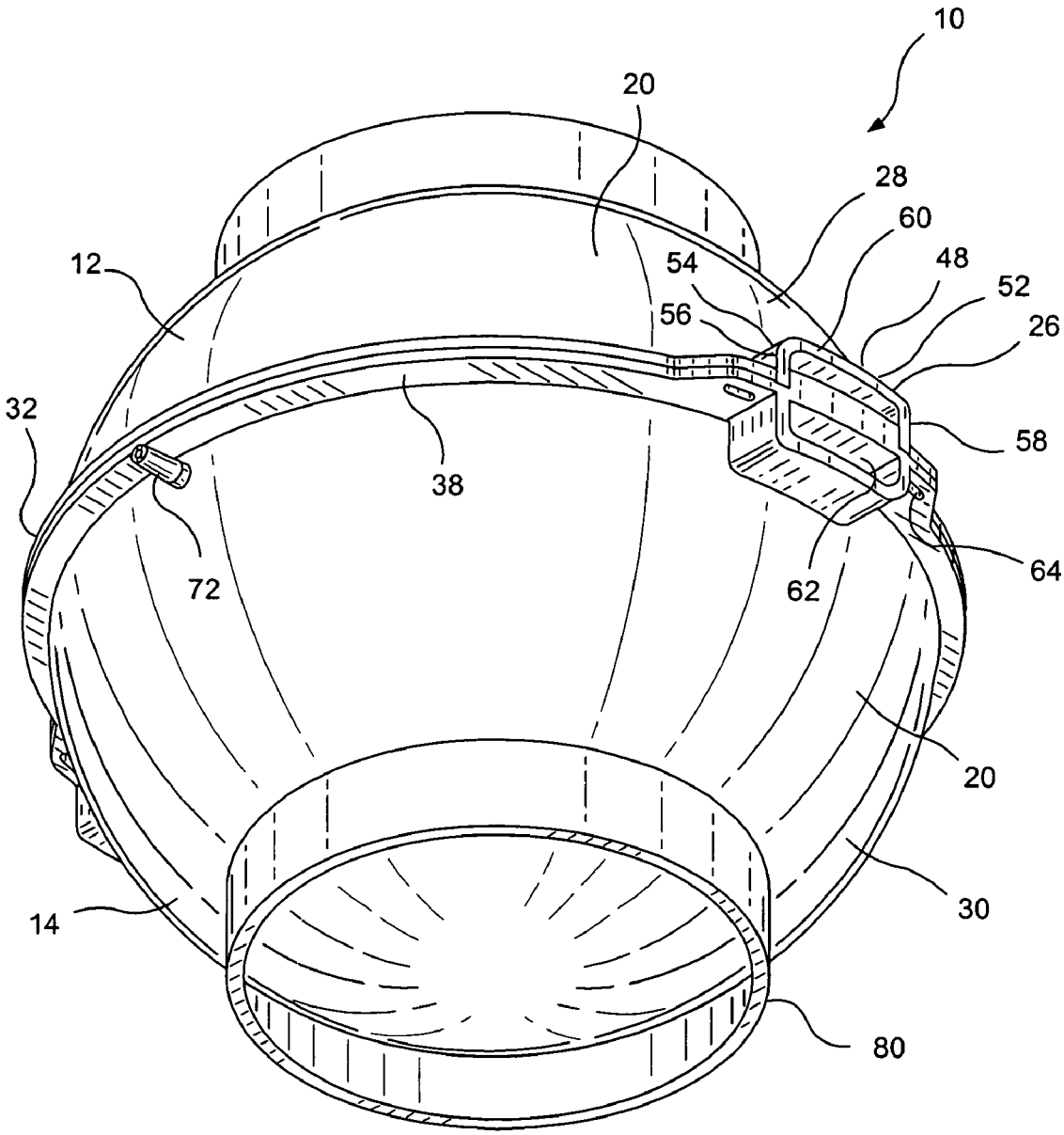
FIG. 1 is a perspective view of a desiccator of the invention.
Figure 2:
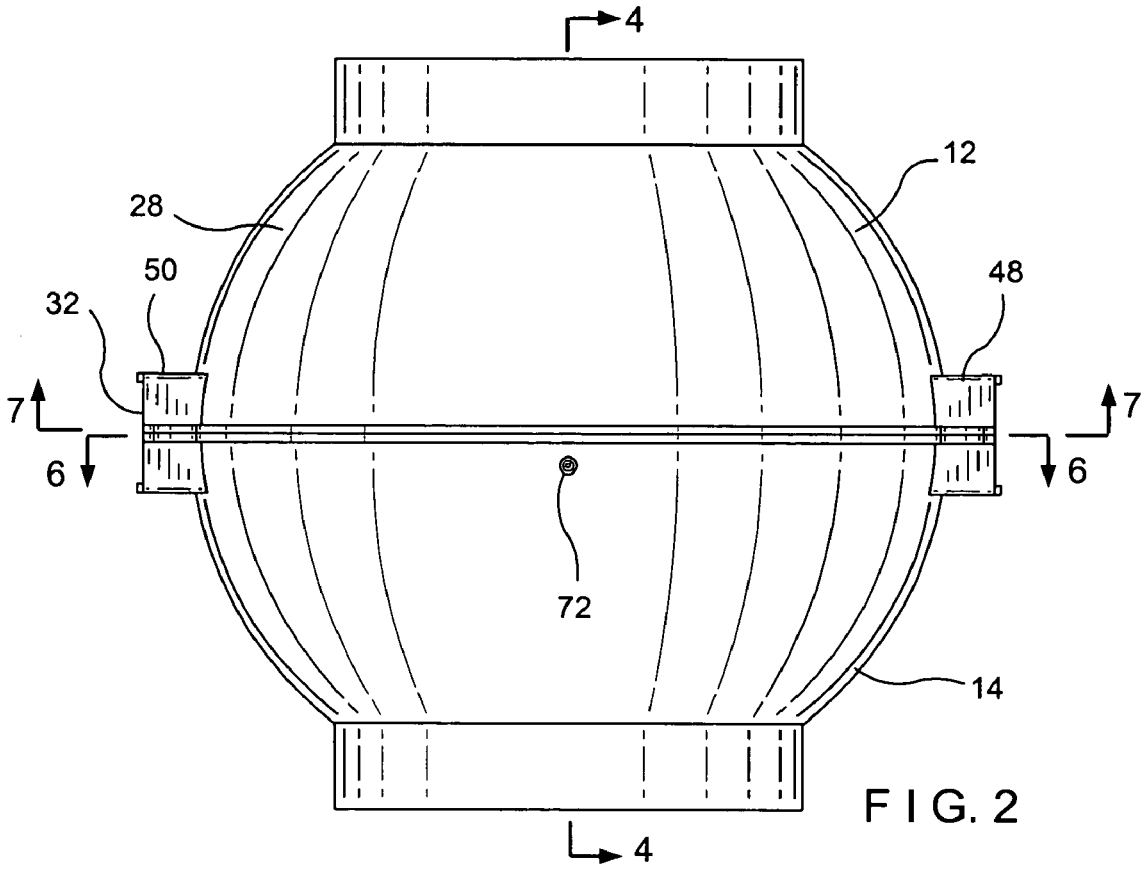
FIG. 2 is a front elevational view thereof.
Figure 3:
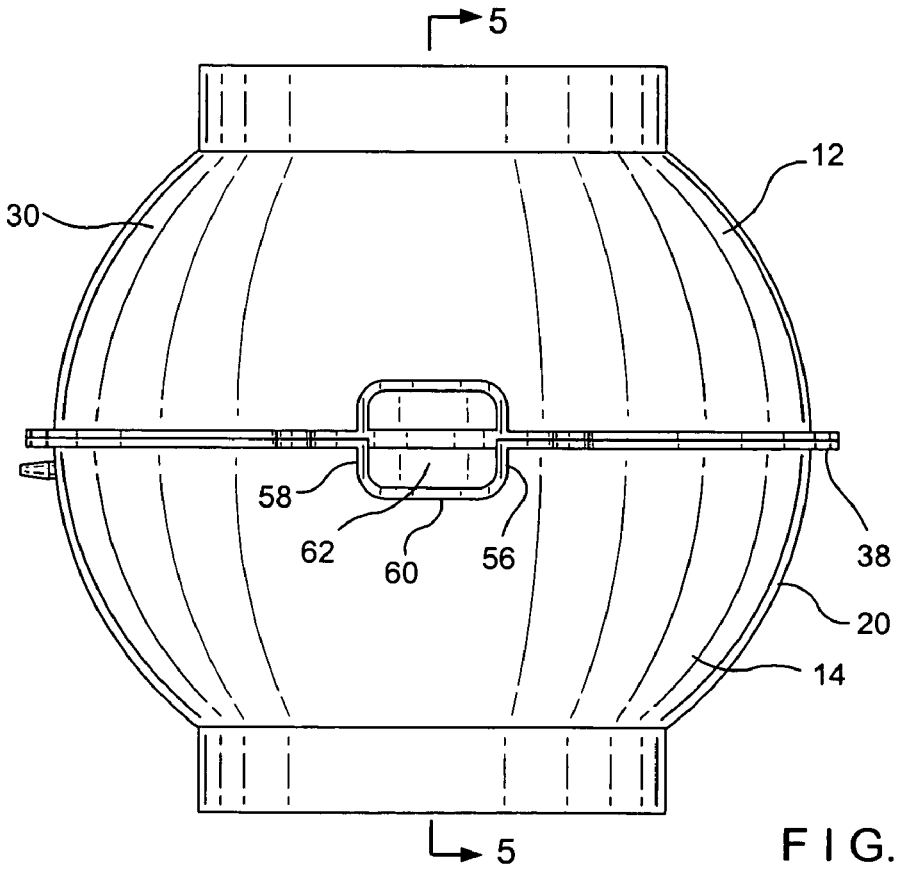
FIG. 3 is a side elevational view thereof.
Figure 8:
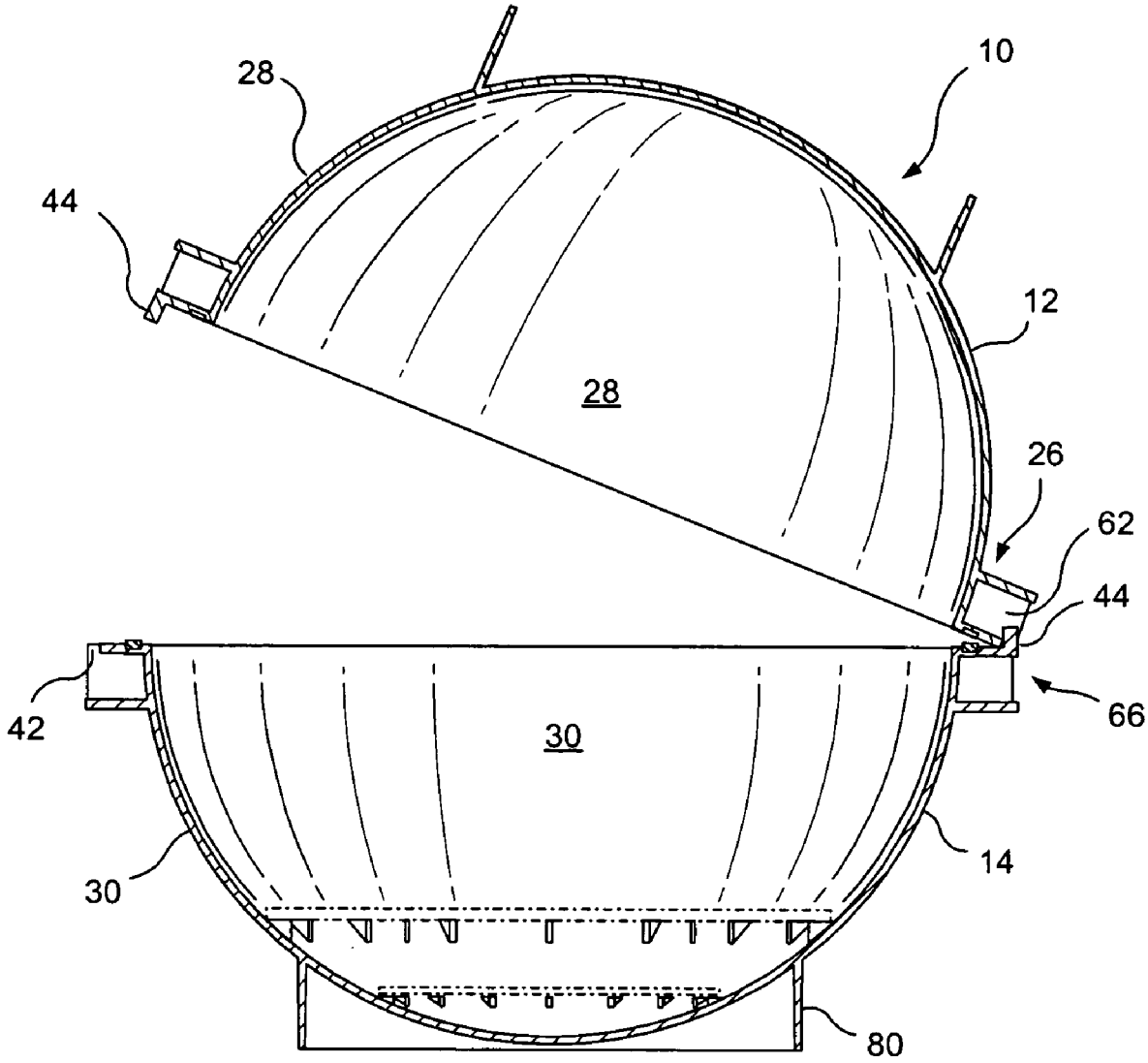
FIG. 8 is a sectional view showing the desiccator of the invention in a semi-open position.
Figure 9:
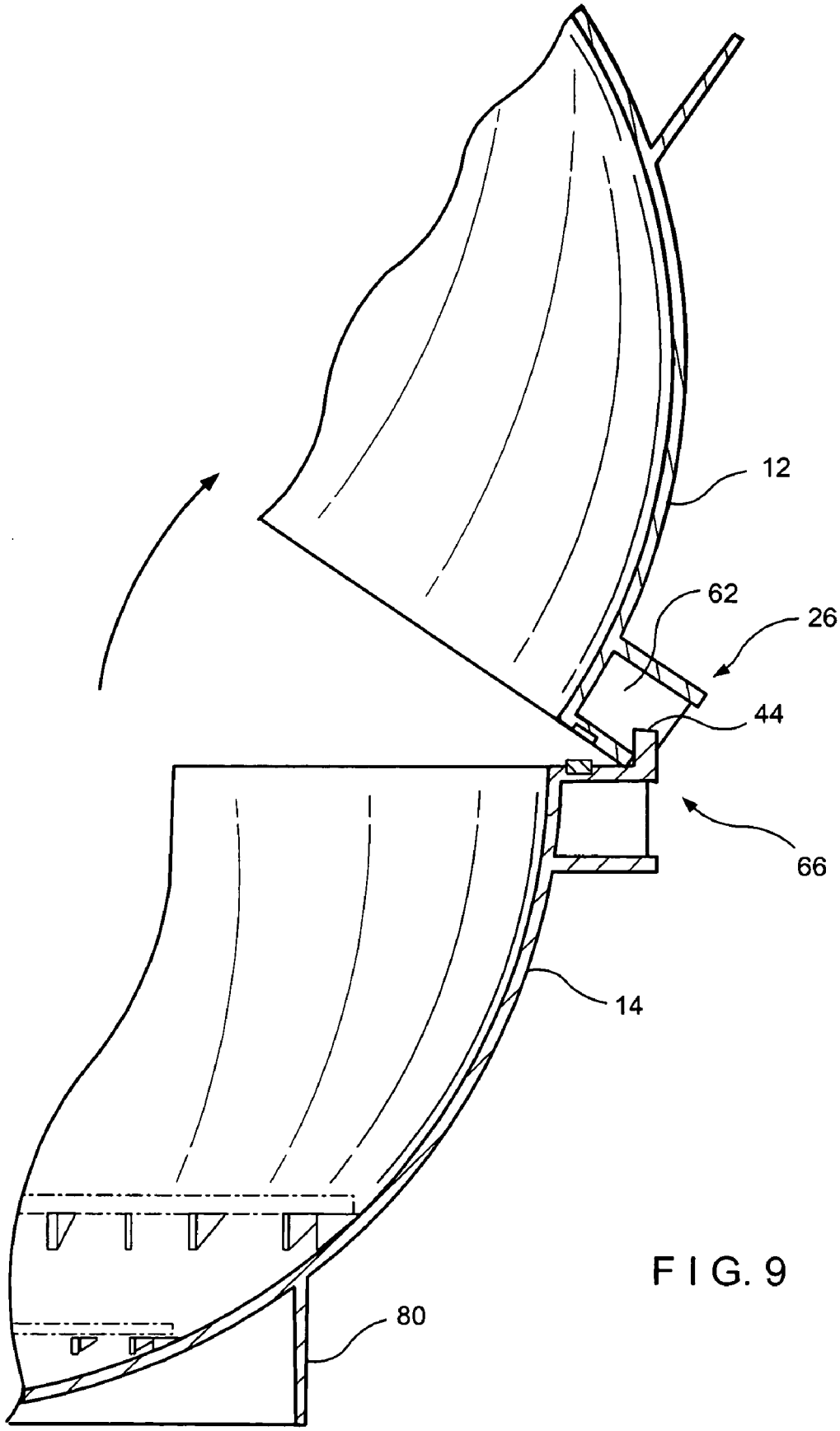
FIG. 9 is an enlarged view showing a pivotal arrangement of FIG. 8.

The engaging interface 26 of each shell further includes first 48 and second 50 clamping regions which are spaced from each other and extend outwardly from the rear face of the engaging flange 38. Referring now to FIGS. 1 and 8 depicting the first clamping region 48 extending between front 52 and rear 54 ends thereof. The rear end 54 is connected to the exterior portion of the shell, whereas the front end 52 is open. Structurally the first clamping region 48 is defined by first 56 and second 58 spaced from each other supporting walls interconnected by a connecting wall 60. The supporting walls extend outwardly from the rear face of the engaging flange, so as to define a substantially hollow clamping cavity 62. The previously discussed receiving segment 42 of the respective projection forms a part of the first clamping region situated between the first 56 and second 58 supporting walls. More specifically, in one embodiment of the invention, the receiving recess 46 extends inwardly from the outer periphery of the projection disposed between the first 56 and second 58 supporting walls. Tying holes 64 are formed within the engaging flange 38 projections and in the close vicinity of the respective supporting walls.

The second clamping region 47 is structurally similar to the above-discussed first clamping region. However, instead of the receiving recess, the connecting member 44 extends transversely from the front portion of the engaging flange disposed between the respective first and second supporting walls.

In the assembled condition of the spherical vacuum desiccator, the first shell is disposed in an inverted position with respect to the second shell in such a manner that the interior surfaces of the first and second shells define a substantially hollow operative chamber 34 within the desiccator having a true spherical configuration. Furthermore, the connecting member 44 of one shell engages the receiving recess 46 of another shell forming a hinge connection 66 facilitating pivotal motion between the first and second hemispherical shells. In the preferred condition of the desiccator, the second hemispherical shell 14 is disposed having the respective interior hemispherical surface 18 and the connecting member 44 to face upwardly, so as to engage the respective receiving recess 46 of the first shell 12 shell and to enable pivotal motion of the first shell with respect to the second shell. To facilitate such engagement the longitudinal extension of the connecting member 44 is substantially equal to the depth of the receiving recess 46 of the receiving segment.

In operation of the invention, while the desiccator is being transferred from an open to closed position and vice versa, the first hemispherical shell 12 moves pivotally with respect to second shell. To assure proper engagement in this motion at least a portion of the second clamping region including the connecting member 44 is received within the inner cavity 62 formed between the first 56 and second 58 supporting walls of the clamping region.

Figure 6:
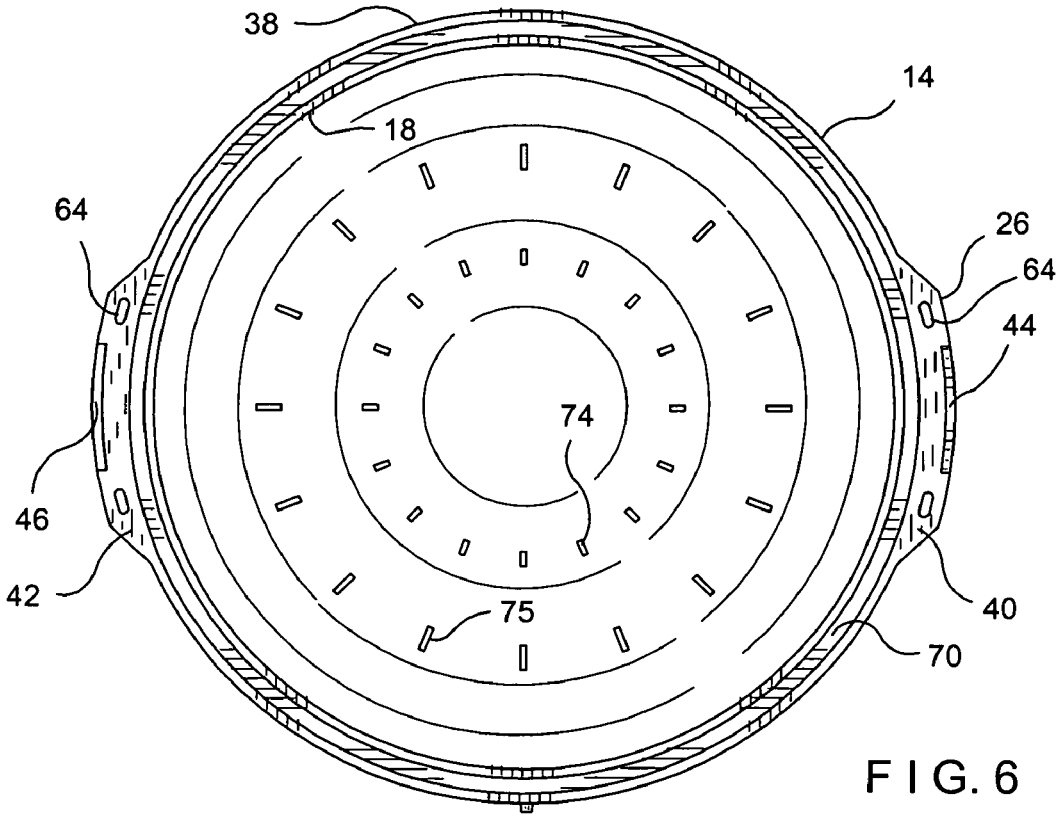
FIG. 6 is a top plan view of one embodiment of the hemispherical shell or sectional view according to section line 6-6 of FIG. 2.
Figure 7:
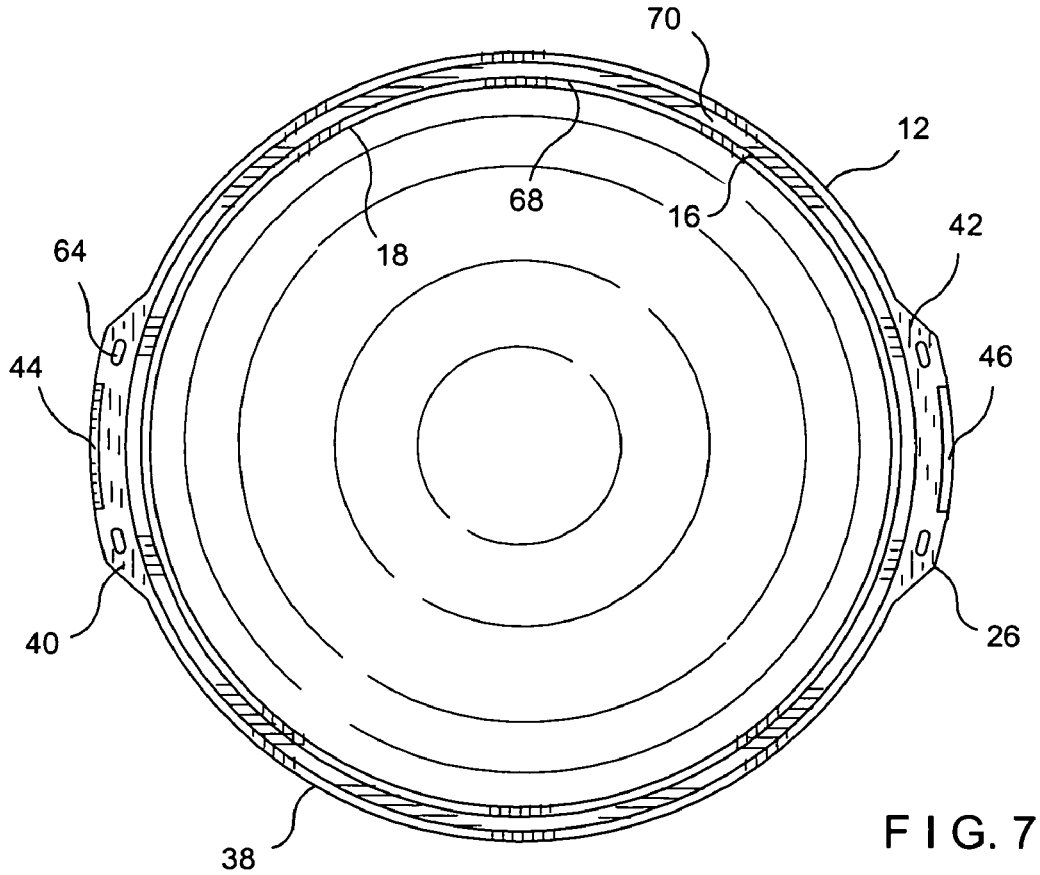
FIG. 7 is a top plan view of another embodiment of the hemispherical shell or sectional view according to section line 7-7 of FIG. 2.

As best illustrated in FIGS. 6 and 7, the engaging flange 38 of each shell includes a substantially flat base surface 68 with a groove or recess 70 is positioned substantially centrally therein and extends inwardly in to the body of the shell from the base surface. While the above-discussed preferred embodiment of the invention discloses the engaging region of the hemispherical shell having one groove, this teaching is by way of example only. Engaging regions of the shells having multiple grooves adapted to receive multiple respective sealing gaskets are within the scope of the invention. The motive for doing so is to create a stronger seal between the matching hemispherical shells of the desiccator.

Each shell can be formed with a port 72 passing through the body thereof, so as to provide communication between the working chamber and an outside source of positive or negative air pressure.

Turning now to FIGS. 4-9, a supporting arrangement 74 can be provided within the working chamber 34 in the form of multiple projections 75, spaced from each other and extending outwardly and circumstantially from the interior surface 18 of at least one shell. The main objective of the arrangement 74 is to support a shelf 77 (shown in phantom) which is adapted to accommodate a substance which is subjected to the desiccation process. A desiccant, such as a silica gel, for example, is positioned at the bottom of the working chamber below the shelf. In this manner an air flow can be established within the desiccation chamber between the substance and the desiccant through the perforation formed within the shelf. To accommodate various products which can be subjected to the desiccation process, the position of the shelf 77 within the working chamber 34 can be adjusted. In the invention this is accomplished by means of providing the supporting arrangement 74 having the projection 75 which is disposed within the chamber 34 at different elevations.

In this manner it is best illustrated in at least FIGS. 4, 5, 8, and 9 that the supporting arrangement 74 consists of a plurality of supporting subassemblies. Each subassembly is defined by multiple spaced from each other projections 75 extending from an interior of the semispherical shell, so as to define a substantially circular formation. Diameters of circular formations vary depending upon their location within the hemispherical shells. In the supporting arrangement, the circular formations are disposed within planes substantially parallel to each other. In the preferred embodiment, the planes of the supporting subassemblies are parallel to a plane of an engaging flange of the respective shell.

A similarly constructed spherical desiccator, that is, a desiccator having a true spherical working chamber and made from the same material and of the same volume and wall thickness, has the lowest described stress on all points within the device. Further, the desiccator having a true spherical working chamber can be made of a thin-walled structure without need for costly reinforcements even as the desiccator is scaled-up to larger sizes due to the efficient design.

Each clamping region is formed with at least one tying hole 64 passing through the respective projections 40, 42, so as to provide a hole large enough to tie the shells together through the use of string, rope, metal attachment apparati, or other devices. The typing holes are typically situated on the projections 40, 42 at a point exterior to the respective supporting walls 54, 56 of the clamping regions. However, the typing holes may be placed anywhere on the projections or in the engaging flange.

A supportive structure 80 is provided at the polar region of each shell 12, 14. The supportive structure 80 can be formed having substantially cylindrical configuration with a diameter large enough to stably support the assembled device 10 on a substantially flat surface such as a laboratory table. The diameter of the cylindrical support 80 is typically great enough to circumscribe reasonable area of the outer portion of the desiccator. In the preferred embodiment the supportive structure forms a unitary assembly with the respective hemispherical shells. However, a desiccator where the supportive structure is independent from the shell is also contemplated.

Figure 10:
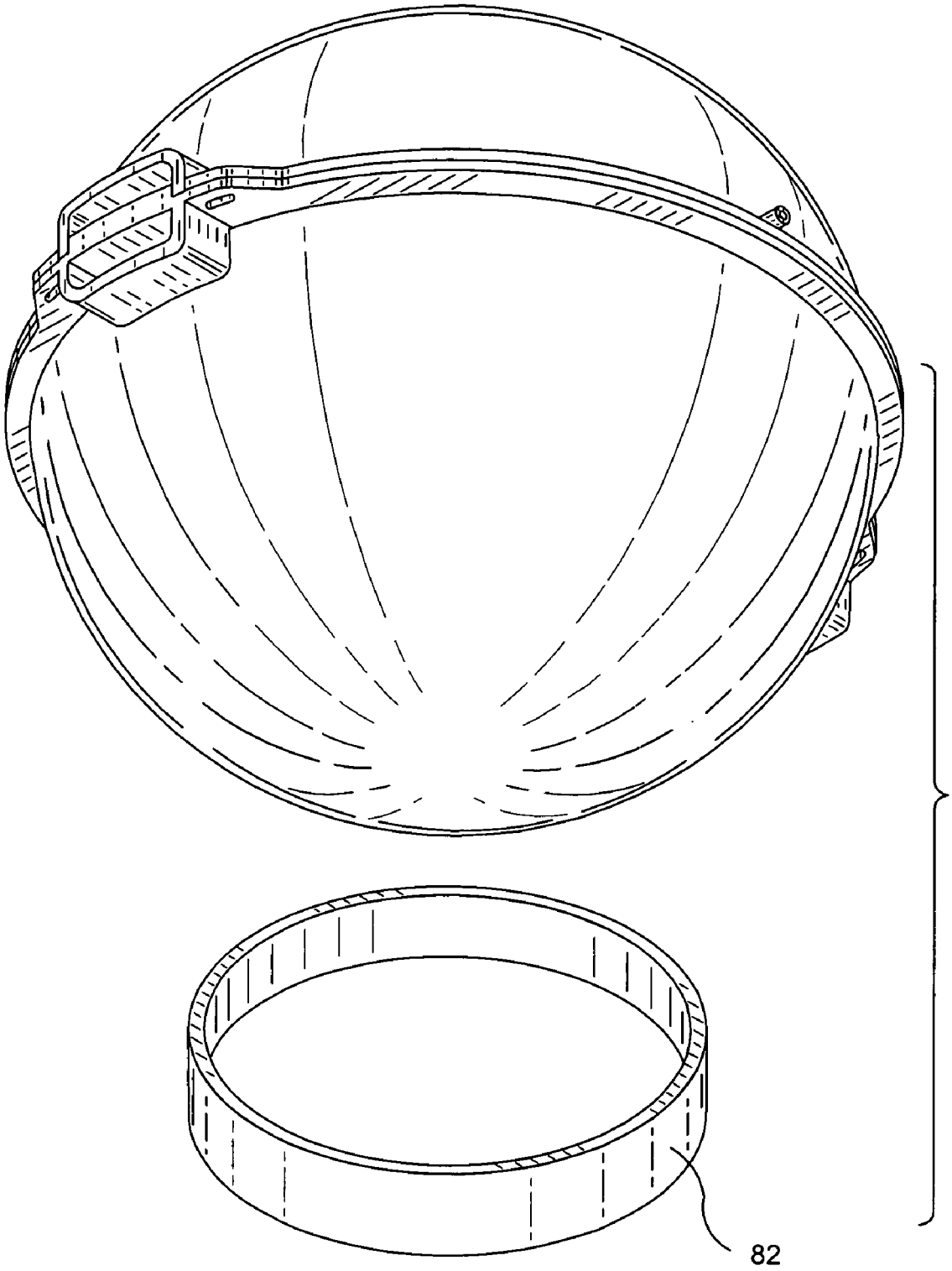
FIG. 10 is a perspective view of another embodiment of the desiccator of the invention.
Figure 11:
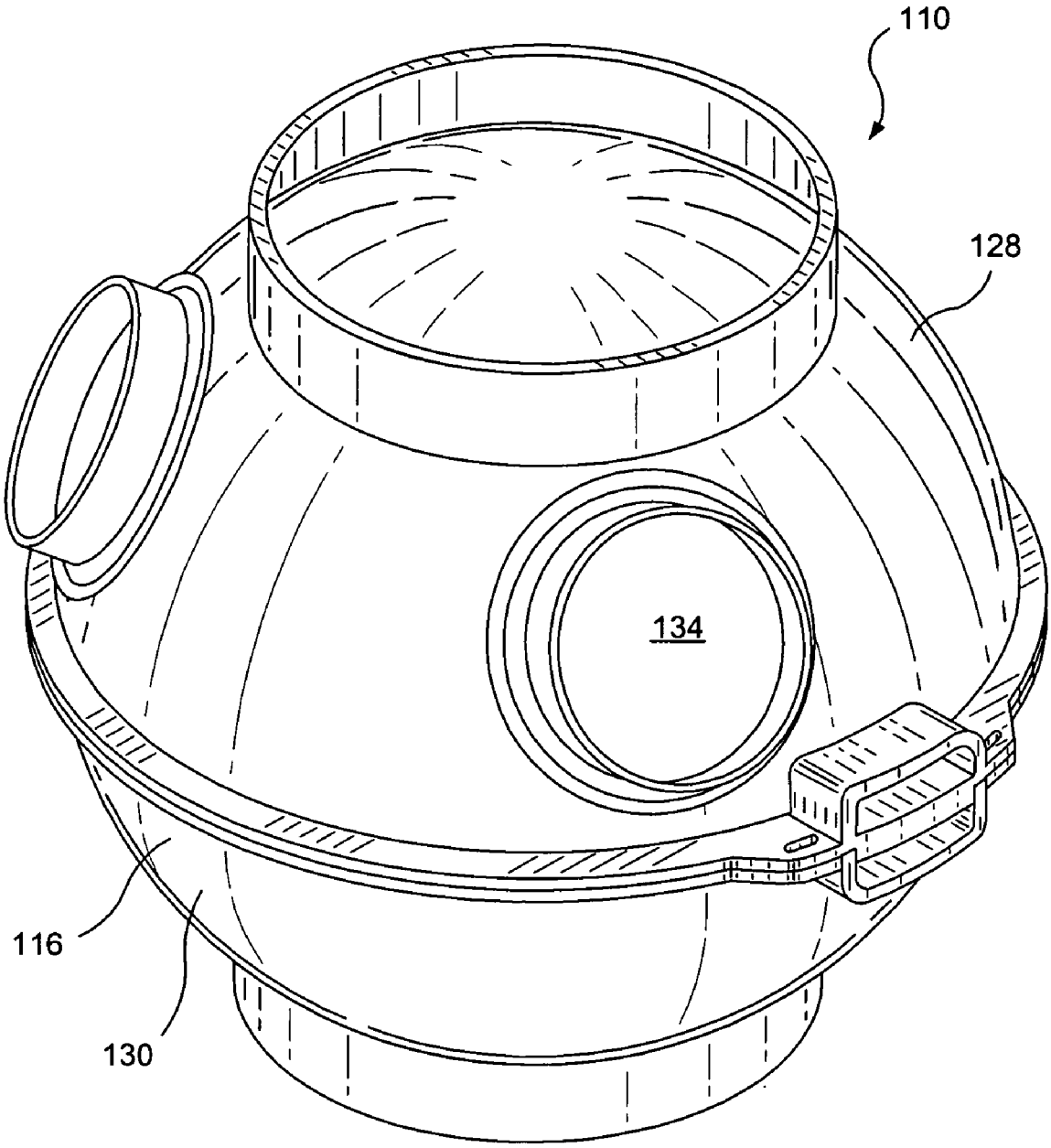
FIG. 11 is a perspective view of a further embodiment of the invention showing one hemispherical shell formed with port sub-assemblies.
Figure 12:
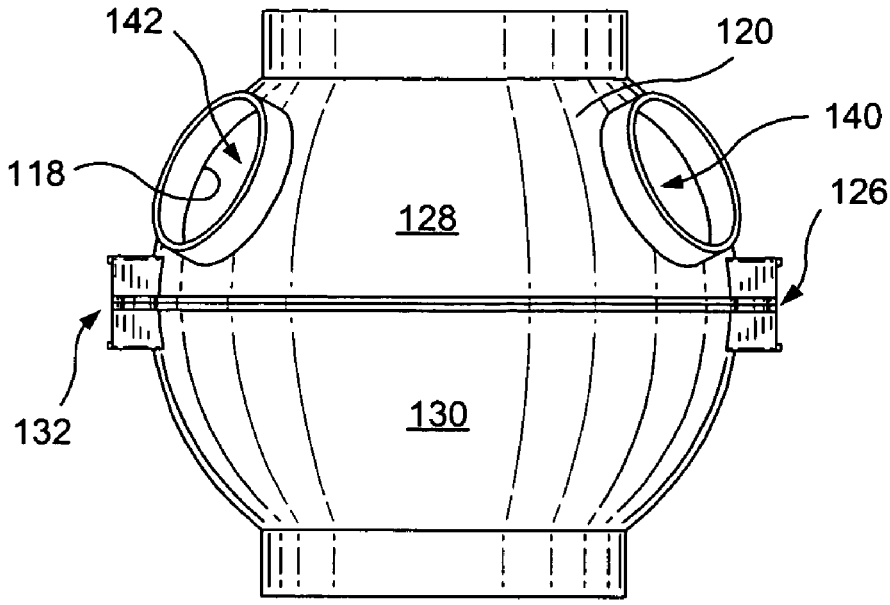
FIG. 12 is a front elevational view thereof.
Figure 13:
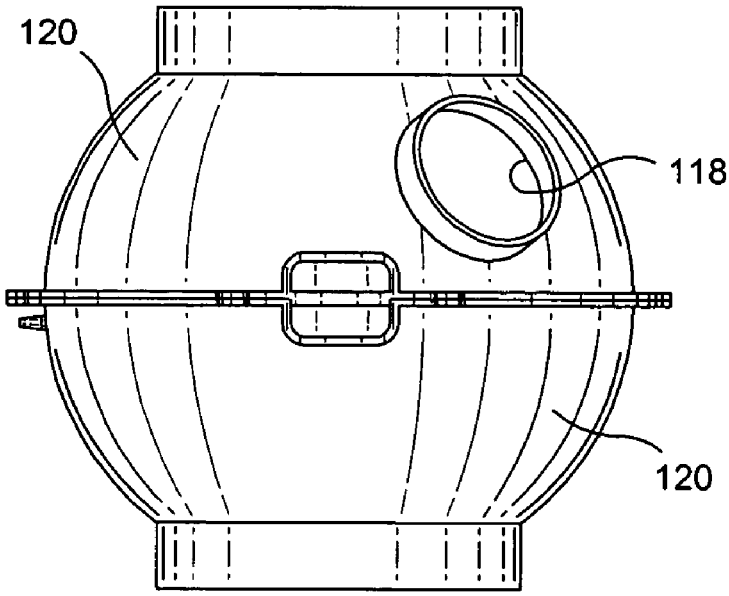
FIG. 13 is a side elevational view thereof.
Figure 14:
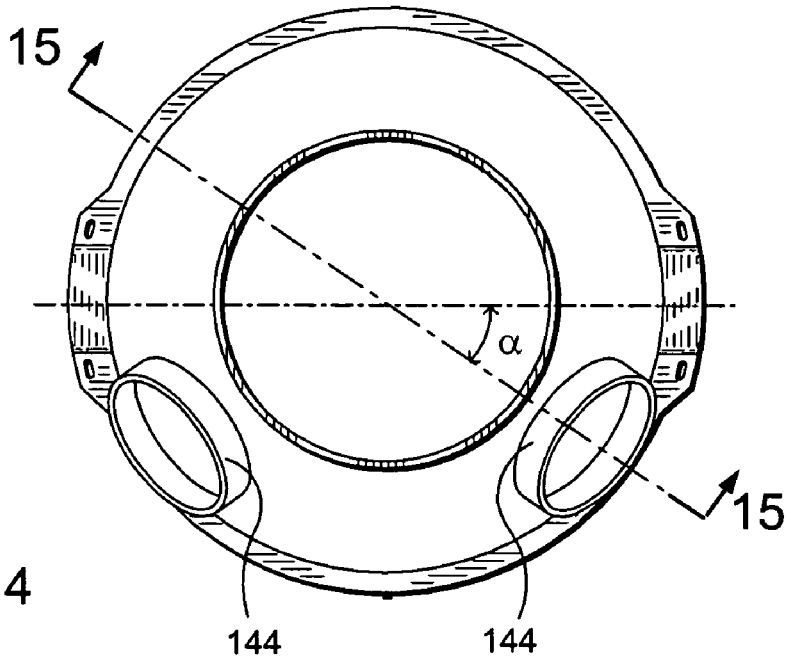
FIG. 14 is a top plan view thereof.
Figure 15:
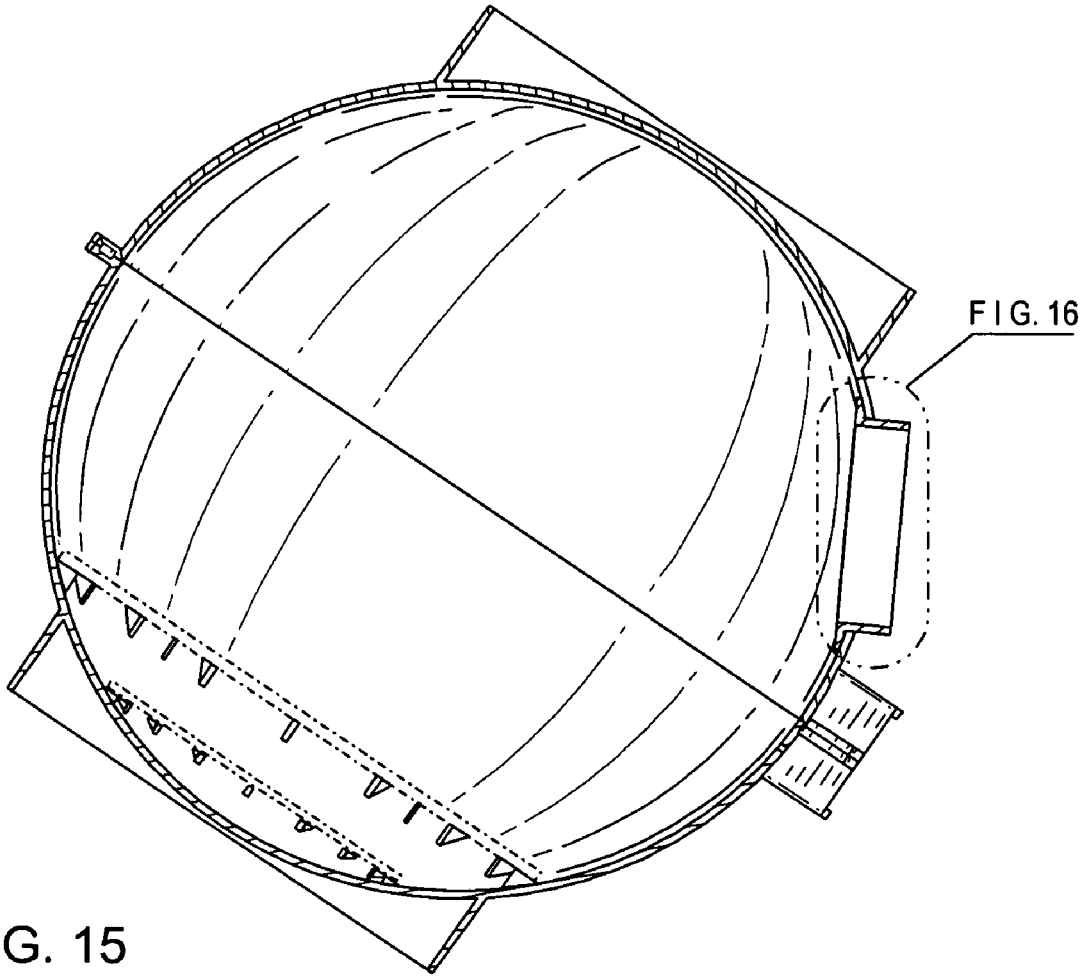
FIG. 15 is a sectional view according to section line 15-15 of FIG. 14.

In the embodiment of the invention illustrated in FIG. 10, the supportive structures 82 are in the form of separate are detachable members. Such members should retain at least the characteristics of the cylindrical supports 80, that is having a proper height, width, and periphery to support the device 10 on a substantially flat surface. While substantially cylindrical supports 80 have been discussed hereinabove, this has been taught by example only. It should be noted that any conventional configuration of the support structure is within the scope of the invention. The body of the shells is typically made of a solid plastic or any other deformable material. Alternatively, to enable an observer to view the process taking place within the working chamber, the body of the shells can be made from a transparent material.

Simplification of manufacture and reduced cost of production is an important objective which exists in the field of desiccators. While many desiccators are known in the art, very few of them are inexpensive and simple to manufacture and assemble. In the present invention this important goal is accomplished by utilizing a combination of the first 12 and second 14 substantially identical shells having interior hemispherical cavities 28 and 30 respectively to form a single element having a true spherical internal working chamber 34.

The true spherical substantially hollow internal working chamber 34, in contrast to all other configurations, is perfectly symmetrical and has an equal distance from the center point to any point on the surface. The true sphere has the smallest surface area among all surfaces enclosing a given volume and it encloses the largest volume among all closed surfaces with a given surface area.

The true spherical internal working chamber 34 solves the long recognized problem of uniform desiccation of a gas. The position and velocity vectors of a point traveling on a sphere are always orthogonal to each other. Therefore, any molecule moving within the true spherical working chamber 34 will move in a similar fashion to every other molecule. The result is equal desiccation without the formation of stagnant or even slowed air pockets which leads to inefficient drying. It is also well known that the effectiveness of desiccation is limited by the amount by which air pressure within the desiccation device can be lowered. The lower volume of air subjected to the desiccation process, the less moisture to be absorbed by the desiccant. In this respect, since the true spherical configuration of the working chamber 34 provides the smallest surface area, it contains less air then the prior art chambers having different configuration. Thus, the greater efficiency is achieved by the invention, since less moisture should be absorbed during the desiccation process.

The true spherical operational chamber 34 results in equal pressure at any given point within the desiccator thereby allowing for the greatest positive or negative pressure available for a desiccator constructed of similarly made structural elements having with similar thickness of walls. Further, structural integrity of the true spherical operational chamber 34 remains intact when a sphere is scaled upwards or downwards. Thus, the desiccator of the present invention having true spherical operational chamber 34 may vary in magnitude to a much greater degree than desiccators known in the art. Therefore, this invention should satisfy the long felt need of laboratories for simple, inexpensive, truly efficient, strong, and safe desiccators.

The present invention comprises two identical and structurally unitary pieces. Thereby, the present invention accommodates various requirements of various types of laboratories. Such accommodation is achieved primarily because the desiccator can be custom configured for varying laboratory needs in a relatively simple, quick and efficient manner. By merely selecting the required desiccation needed, calculations can be made to determine the size of the desiccator and strength for which it must withstand. The material for constructing the device is thereby selected and the clamping region is contracted or enlarged and the requisite number of grooves added to create the structure necessary for varying laboratory needs. A desiccator can thus be provided having various holding capacities to accommodate various equipment and products positioned therein. Moreover, the identical and separable structure substantially simplifies shipment, storage and assembly of the desiccator.

The present invention provides a new and improved desiccant device of a spherical shape which can be made with commonly available materials for easy and efficient manufacture. While polymers, plastics, and glass are all suitable materials, any durable and reliable material capable of maintaining structural integrity while exposed to varying degrees of pressure is suitable for the apparatus.

Referring now to FIGS. 11-18, illustrating a further embodiment of the hemispherical shell of the invention. As best illustrated in these figures the top shell consists of a body having an interior hemispherical surface 118 and exterior surface or portion 120, with an engaging interface provided at the lower end thereof. In the assembled condition, similar to the above-discussed embodiments, the desiccator 110 consists of a first hemispherical cavity 128 and second hemispherical cavity 130. The interior surfaces 128 and 130 of the first and second cavities substantially mirror each other and interlock in an airtight seal at a connecting region 132, which is equidistantly oriented between the poles of the respective hemispherical cavities. In this manner the hollow, spherical operational chamber 134 is formed.

The top hemispherical shell is formed with at least two port sub-assemblies 140 and 142 provided in a central area of a front region of one hemisphere. In the preferred embodiment each port assembly is formed having a coupling unit 141. As best illustrated in FIGS. 17 and 18, each coupling unit consists of a coupling sleeve 144 extending outwardly from a connecting flange 146 which is defined by an exterior convex surface 148 and an interior concave surface 150. The sleeve 144 is typically formed having a substantially cylindrical configuration, whereas the convex surface 148 and the concave surface 150 are adapted to engage the wall of the respective semi-spherical shell. In this respect, it is illustrated in FIG. 17 that in one embodiment of the invention, the exterior convex surface 148 is adapted to engage an interior hemispherical surface 118. In this embodiment, the sleeve 144 extends from the interior area of the desiccator outwardly so as to provide an adequate area for receiving a respective portion of the glove. In the embodiment of FIG. 18, the concave interior surface 150 of the coupling sleeve engages the exterior hemispherical surface 120 of the respective shell.

The coupling unit 141 can be manufactured independently from the desiccator and is attached to the shell by any conventional means. On the other hand, the coupling unit 141 can be formed as an integral part of the shell.

The coupling unit 141 forms part of a glove box accessory adapted to provide a controlled environment for testing and material handling operations. The interior of the desiccator forms an enclosure configured to permit substances to be introduced into or removed form the enclosure. The spherical walls of the desiccator can be formed from a transparent flexible material such as, for example, polyvinyl chloride (PVC) or LEXAN. This arrangement allows users to view and handle substances situated in a controlled or contained environment of the operational chamber 134 of the desiccator. Hand entry into the operational diameter 134 is customized to end-user needs by selecting any type of gloves, such as the bellows-type glove, economy sleeve glove, etc. The coupling sleeves 144 are utilized for providing a secure connection with the respective gloves.

A glove 156 for protecting the hand are fixed in a detachable manner to the respective sleeve 144. As conventional in the art, the gloves 156 are made of a flexible material such as rubber. The sleeve and an upper portion of the glove are joined in a gas-tight manner to the respective coupling sleeve.

A retaining element 152 is provided for restraining the glove 156 relative to the desiccator walls when the hand is being removed from the glove. Thus, removal of a hand from the respective glove will not result in the glove being turned inside-out and accordingly, the glove will remain in proper position for insertion of the hand into a glove when usage of the glove is next desired.

What is claimed is:

1. A spherical vacuum desiccator, comprising:

first and second substantially identical hemispherical shells adapted for mutual engagement with each other;

each hemispherical shell comprising a body with inner and outer hemispherical surfaces and an engaging region therebetween, a receiving segment and a connecting segment are positioned in a spaced-apart relationship within said engaging region of each said hemispherical shell, whereby, in the assembled condition of the vacuum desiccator said first hemispherical shell is disposed in the inverted position with respect to the second shell so that the inner surfaces of said first and second shells define a substantially hollow operational chamber within the interior of said desiccator having a true spherical configuration; and each said hemispherical shell further comprises first and second clamping regions spaced from each other, each said clamping region consists of first and second supporting walls extending outwardly from the flange and connected by a connecting wall, so that an inner cavity is formed within each clamping region surrounded by supporting and connecting walls, during said pivotal motion of the second hemispherical shell with respect to the first hemispherical shell at least a portion of the connecting segment of the first hemispherical shell is received within the inner cavity of the second hemispherical shell;

said first hemispherical shell being formed with at least one port subassembly provided in a central area of a front region thereof, so as to provide access to the substantially hollow operational chamber, a coupling unit extends outwardly from the outer hemispherical surface of the first shell so as to surround said port subassembly.

2. The spherical desiccator according to claim 1, wherein said at least one port subassembly consists of two port subassemblies, and a said coupling unit comprises a coupling sleeve extending from a flange adapted for engagement with the respective hemispherical shell.

3. The spherical desiccator as claimed in claim 2, wherein said coupling flange is formed with an exterior surface having a convex configuration and an interior surface having a concave configuration, so that said convex exterior surface is adapted for engagement with a semispherical interior surface of the first hemispherical shell.

4. The spherical desiccator as claimed in claim 2, wherein said coupling flange is formed with an exterior surface having a convex configuration and an interior surface having a concave configuration, so that said concave interior surface is adapted for engagement with a semispherical exterior surface of the first hemispherical shell.

5. The vacuum spherical desiccator according to claim 2, further comprising a pair of gloves made of a resilient material and adapted for engagement with the respective coupling sleeves, a restraining arrangement for restraining each said glove against movement relative to the respective coupling sleeve when a hand of user is being positioned into the glove or removed from the glove.

6. The spherical vacuum desiccator of claim 1, wherein the receiving segment consists of a receiving recess within said engaging region extending inwardly from the respective outer surface;

the connecting segment consists of a connecting member extending transversely to the surface of the respective projection;

each said receiving segment is formed by the first and the second supporting walls extending outwardly from the flange and connected by a the connecting wall, so that said receiving recess is formed surrounded by supporting and connecting walls;

whereby in an assembled condition of the vacuum desiccator, said first hemispherical shell is disposed in an inverted position with respect to said second hemispherical shell in such a manner that said connecting member of the first shell movable engages said receiving recess of the second shell forming a hinge connection facilitating pivotal motion between said first and second hemispherical shells, during said pivotal motion of the hemispherical shells with respect to each other at least a portion of the connecting segment of the one hemispherical shell is received within the receiving recess of the other hemispherical shell.

7. The spherical vacuum desiccator according to claim 6, wherein said engaging region of each said shell is a flange extending normally to the inner and outer surfaces.

8. The spherical vacuum desiccator according to claim 7, wherein each said connecting segment is formed by first and second supporting walls extending outwardly from the flange and connected by a connecting wall, so as to form a connecting recess surrounded by the supporting and connecting walls.

9. The spherical vacuum desiccator according to claim 8, wherein said first and second connecting walls are substantially parallel to each other and said connecting wall extends in a parallel relationship to the engaging region/engaging flange.

10. The spherical vacuum desiccator according to claim 6 wherein in the assembled condition the inner surfaces of said first and second shells define a substantially hollow operational chamber within the interior of said desiccator having a true spherical configuration.

11. The spherical vacuum desiccator according to claim 6 wherein said outer surfaces of the first and second shells define a body having a true spherical configuration, and said engaging region being disposed within a plane positioned substantially parallel to a surface supporting said vacuum desiccator.

12. The spherical vacuum desiccator according to claim 11, further comprising a supporting arrangement consisting of a plurality of supporting subassemblies, each said supporting subassembly is defined by a multiplicity of spaced from each oilier projections extending from an interior of at least one semispherical shell defining a substantially circular formation.

13. The spherical vacuum desiccator according to claim 12, wherein in the supporting arrangement the circular formations are formed having various diameters and spaced from each other to the disposed within planes substantially parallel to each other and parallel to a plane of an engaging flange of the respective shell.

14. The spherical vacuum desiccator according to claim 6 wherein a supportive structure extends outwardly from the outer surface of each said hemispherical shell and said structure is adapted for engagement with a supportive surface.

15. The spherical vacuum desiccator according to claim 14 wherein in each said hemispherical shell the engaging region further comprises a flange extending outwardly from said outer surface and circumferentially, so as to substantially surround the outer periphery of the respective shell.

16. The spherical vacuum desiccator according to claim 6 wherein in said assembled condition of the desiccator said first hemispherical shell is disposed having said respective interior surface and said receiving recess facing upwardly, so as to receive the respective connecting member of the second shell to facilitate pivotal motion of the second shell with respect to the first shell.

* * * * *